United States Patent [19]

Wasson et al.

[11] 4,388,152

[45] Jun. 14, 1983

[54] PROCESS FOR PRODUCING BLAST FURNACE GRADE COKE, A DISTILLABLE PRODUCT AND FUEL GASES FROM A HEAVY, HIGH SULFUR, CRUDE OIL

[75] Inventors: George E. Wasson, Eighty Four; Frank W. Theodore, Pittsburgh, both of Pa.; Lyndon D. Boyer; Matthew C. Sooter, both of Ponca City, Okla.

[73] Assignee: Conoco Inc., Stamford, Conn.

[21] Appl. No.: 341,381

[22] Filed: Jan. 21, 1982

Related U.S. Application Data

[63] Continuation-in-part of Ser. No. 174,981, Aug. 4, 1980, abandoned.

[51] Int. Cl.[3] ..... C10B 49/06; C10B 55/06; C10B 57/02

[52] U.S. Cl. ..... 201/6; 201/17; 201/28; 201/30; 201/42

[58] Field of Search ..... 208/95, 97, 131, 50, 208/53; 201/5-8, 15-17, 22, 23, 25, 27, 28, 30, 31, 33, 42

[56] References Cited

U.S. PATENT DOCUMENTS

| | | | |
|---|---|---|---|
| 1,912,629 | 6/1933 | Fisher . | |
| 2,340,974 | 2/1944 | Myers | 208/50 |
| 3,051,628 | 8/1962 | Gorin et al. . | |
| 3,101,303 | 8/1963 | Batchelor et al. . | |
| 3,117,918 | 1/1964 | Batchelor et al. . | |
| 3,401,089 | 9/1968 | Friedrich et al. | 201/6 |
| 3,403,989 | 10/1968 | Blake et al. . | |
| 3,472,761 | 10/1969 | Cameron | 208/53 |
| 3,748,254 | 7/1973 | Gorin . | |
| 3,770,418 | 11/1973 | Wilde . | |
| 3,775,294 | 11/1973 | Peterson et al. | 208/50 |
| 4,039,319 | 8/1977 | Schapiro et al. . | |
| 4,058,451 | 11/1977 | Stolfa | 208/97 |
| 4,292,165 | 9/1981 | Sooter . | |

OTHER PUBLICATIONS

Thermal Process is Developed for Petroleum Coke Desulfurization, F. M. Sadilla, The Oil and Gas Journal, Jan. 22, 1979, pp. 64-68.

Chemistry of Coal Utilization, vol. 1, H. H. Lowry, John Wiley & Sons, Inc., London, Chapman & Hall, Ltd., 1945, pp. 448, 449, 587, 588.

*Primary Examiner*—Bradley Garris

*Attorney, Agent, or Firm*—Dale Lovercheck; William A. Mikesell, Jr.

[57] ABSTRACT

A process for producing a distillable hydrocarbonaceous stream, fuel gases and blast furnace grade coke from a heavy, high sulfur, crude oil by producing delayed coke from at least a portion of the crude oil; crushing at least a portion of the coke to provide a finely divided coke feedstock to a briquetting operation where the finely divided coke is briquetted using crude oil or topped crude oil as a binder to produce briquettes of a size from about ¾ inch to about 3 inches with the resulting briquettes being passed to a high temperature vertical calciner where the solids are desulfurized to produce a strong blast furnace grade coke. The distillable stream and fuel gas stream are recovered from the delayed coking operation, the vertical calciner and optionally a crude oil topping operation. In some instances coke particles in the size range from about ¾ inch to about 3 inches may be passed directly to the calciner without crushing and briquetting. However, it is preferred to crush and briquette substantially all of the coke.

11 Claims, 1 Drawing Figure

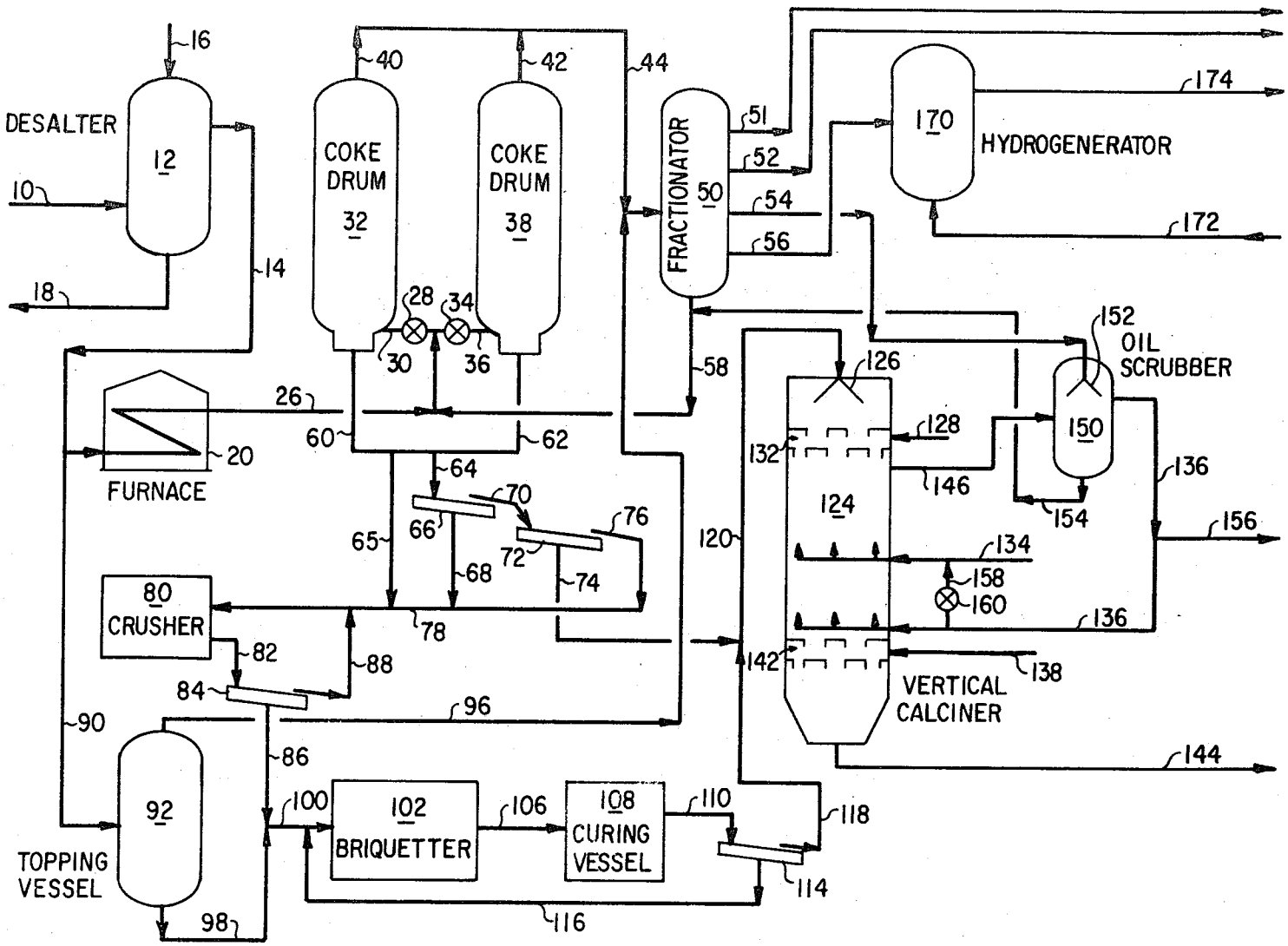
HYDROGENERATOR
OIL SCRUBBER
VERTICAL CALCINER
FRACTIONATOR
COKE DRUM 38
COKE DRUM 32
DESALTER
FURNACE
CRUSHER
BRIQUETTER
CURING VESSEL
TOPPING VESSEL

PROCESS FOR PRODUCING BLAST FURNACE GRADE COKE, A DISTILLABLE PRODUCT AND FUEL GASES FROM A HEAVY, HIGH SULFUR, CRUDE OIL

This is a continuation-in-part of U.S. Ser. No. 174,981 filed Aug. 4, 1980 now abandoned.

This invention relates to processes for converting heavy high sulfur, crude oils into valuable products.

This invention further relates to a process for producing a distillable hydrocarbonaceous stream, fuel gases and metallurgical grade coke from a heavy high sulfur, crude oil.

The recent well-known shortage of petroleum products worldwide has led to an increased interest in the use of petroliferous fuels heretofore considered unrecoverable for economic reasons. Some such fuels comprise heavy hydrocarbonaceous deposits which comprise heavy, high sulfur, crude oil hydrocarbonaceous materials. Such deposits are found in a variety of locations in the world, including the United States, Canada and Venezuela. The recovery of hydrocarbonaceous materials from such deposits is difficult and even when the hydrocarbonaceous materials have been recovered, the refining of the recovered material i.e., heavy, high sulfur, crude oil is difficult using existing technology. As a result of the increasing shortage of crude oils, and the increasing price of crude oil, it has become increasingly desirable to develop processes whereby such heavy, high sulfur, crude oils can be converted into desirable products. Typically heavy high sulfur crude oils have from 4 to 11 weight percent sulfur.

In the past, heavy crude oils or resid oils have been processed to produce petroleum coke of various grades. The production of petroleum coke by delayed coking is a realtively well-established technology and some representative processes are disclosed in U.S. Pat. No. 3,116,231 issued Dec. 31, 1963; U.S. Pat. No. 3,173,852 issued Mar. 16, 1965; U.S. Pat. No. 3,472,761 issued Oct. 14, 1969; U.S. Pat. No. 3,723,291 issued Mar. 27, 1973 and U.S. Pat. No. 3,907,664 issued Sept. 23, 1975. Typically, a substantial part of the petroleum coke is of a size less than about 6 Tyler Mesh. It is used for a variety of purposes, many of which require a relatively low metals content. The sulfur content of such petroleum coke can be reduced by high temperature treatment in vertical calciners as discussed for instance in an article entitled "Thermal Process is Developed for Petroleum Coke Desulfurization," Sadilla, Fernando Manzanilla; La Monte, Oliverio Mereno; Sze, MC. and Bauer W. V., Oil and Gas Journal, Jan. 22, 1979, pp. 64–67, which discloses a process wherein petroleum coke is desulfurized by heating to temperatures from 1320° to about 1500° C.

The process of the invention is directed to the production of blast furnace quality coke. To be minimally acceptable as blast furnace coke the hardness factor must be at least about 50 to 55 and the sulfur content must be at least as low as 2 percent by weight or less. The desulfurized coke of Sadilla is on inadequate hardness to be used as blast furnace coke. Sadilla is directed to the production of electrode coke for the aluminum industry. Stolfa, U.S. Pat. No. 4,058,451 discloses the production of coke from crude oil to produce metallurgical coke. The coke of Stolfa is of inadequate hardness for use as blast furnace coke. Because Stolfa does not discuss hardness or size, presumably he is not concerned with these primary considerations of blast furnace coke. Stolfa, like Sadilla, may be directed to the aluminum industry and electrode coke.

Sooter, U.S. Pat. No. 4,292,165, discloses coal liquefaction followed by delayed coking distillation and calcining to produce coke. Here again, the hardness of the coke product is not considered and is not expected to be sufficient for use as blast furnace coke.

It has now been found that such crude oils can be used to produce liquid hydrocarbonaceous streams, fuel gases and blast furnace grade coke. Such products are produced by a process which in general comprises producing delayed coke from a quantity of the crude oil; grinding at least a portion of the coke and briquetting the ground coke using a crude oil or a topped crude oil binder to produce briquettes of the desired size, i.e., about ¾ inch to about 3 inches with the briquettes then being charged to a vertical calciner where the sulfur content of the briquettes is reduced to a preferred acceptable level, i.e., less than about 1 weight percent sulfur, to produce a blast furnace grade coke. In such processes, it has been found that when using heavy crude oils, it is unnecessary to top the crude oil charged to the delayed coking drums to produce the coke so that liquid products and fuel gases are recovered from the coking drums and are available as a product from the process. Additional quantities of liquid products and fuel gases may be recovered from the topping of the crude oil used as a binder in the production of the briquettes and from the operation of the vertical calciner. In some cases, provided the resulting coke has sufficient strength for use as lower strength bulk in blast furnace coke, delayed coke of a size from about ¾ inch to 3 inches may be passed directly to the calciner rather than being crushed and briquetted. However, the strength of this unbriquetted calcined coke is insufficient for use alone as blast furnace coke. About 5 percent of this unbriquetted coke could be tolerated in mixture with strong coke briquettes made in accordance with the invention.

The FIGURE is a schematic diagram of a process embodying the present invention.

In the FIGURE, a crude oil stream is charged to a desalter vessel 12 through a line 10 with the desalted crude oil being recovered through a line 14. The desalter is of any type suitably used in the desalting of crude oils and comprises generally a vessel where crude oil is contacted with an aqueous solution for the removal of water-soluble inorganic constituents. Water is charged to vessel 12 through a line 16 and recovered with contaminants removed from the crude oil through a line 18. The operation of desalting vessels is well-known to those skilled in the art and does not constitute a part of the present invention. The desalted crude oil stream recovered through line 14 is passed to a furnace 20 where it is heated to a temperature suitable for use as a feedstream to one of a pair of delayed coking drums 32 and 38. The heated crude oil passes through a line 26 to one or the other of coking drums 32 or 38 with flow being directed to drum 32 via a valve 28 and a line 30 and to drum 38 via a valve 34 and a line 36. The operation of delayed coking drums to produce petroleum coke is considered to be known to those skilled in the art and in the usual practice of the delayed coking process, residual oil is heated and fed into the bottom of a coking drum where the first stages of thermal decomposition reduce the oil to a very heavy tar or pitch which further decomposes into solid coke. The vapors formed during the decomposition produce pores and channels in the coke through which the incoming oil from the furnace may pass. This process continues until the drum is filled to a desired level with a mass of coke. The vapors formed in the process leave the top of the drums via lines 40 and 42 and are passed to further processing via a line 44. The resulting coke is removed from coking drums 32 and 38 through lines 60 and 62 by means known to those skilled in the art such as the use of high pressure water jets or the like. In the normal operation of delayed coking drums such as drums 32 and 38 one drum will be fed with a feedstock until the drum is substantially filled with coke and thereafter feed will be switched to the other drum, which will receive the feed and produce coke while the first drum is emptied. Clearly, more or less than two drums could be used although the use of a pair of drums is a frequent arrangement. The resulting coke is recovered from drum 32 via a line 60 and from drum 38 via a line 62 and passed through a line 65 to a line 78 and a crusher 80 or through a line 64 to a screen 66 where coke of a size smaller than about ¾ inch is recovered as an undersize stream from screen 66 via a line 68 and passed to line 78. The oversize coke is recovered as shown by arrow 70 and passed to a screen 72 where coke of a size smaller than about 3 inches is recovered via a line 74 and passed to further processing with oversize coke, i.e. larger than about 3 inches, being recovered via a line 76 and combined with the undersize stream in line 78 through which the coke passes to crusher 80. While not shown, the oversize stream in line 76 could be further crushed and screened to produce an additional quantity of material in line 74 of the desired size i.e. from about ¾ inch to about 3 inches. Such variations are known to those in the art and have not been shown for simplicity although such variations are considered to be within the scope of the present invention as are variations in the process used for the size separation of the solids. In crusher 80 a finely divided coke stream of a size typically less than about 6 Tyler Mesh and desirably smaller than about 8 Tyler Mesh is produced and passed to a screen 84. Screen 84 separates the finely divided stream into a stream of a size less than about 6 Tyler Mesh, desirably smaller than about 8 Tyler Mesh and in some instances smaller than about 28 Tyler Mesh which is recovered as an undersize stream through a line 86 with the oversize material being recycled through a line 88 to grinder 80. The finely divided coke of the desired size is passed through a line 100 to a briquetter 102. It is necessary that a binder be used to provide a briquettable mixture in briquetter 102 and it has been found that a desirable binder is produced from the same crude oil used to produce the coke by topping a portion of the crude oil although any suitable binder can be used. The crude oil is charged through a line 90 to a topping vessel 92 to produce a topped crude oil stream which is recovered through a line 98 and passed to mixture with the finely divided coke flowing through line 86. A vaporous stream is recovered from topping vessel 92 and passed through a line 96 to further processing. The finely divided coke and the bottoms stream are blended in proper proportions and charged through line 100 to briquetter 102. Clearly a mixing vessel (not shown) is usually required to achieve intimate mixing to produce a briquettable mixture. Mixers known to those skilled in the art are suitable and need not be discussed in detail. It may be found desirable to provide a finely divided coke storage vessel (not shown) in line 86 and a topped crude storage vessel (not shown) in line 98 to control the proportions of the materials blended to form the briquettable mixture. The need for such storage vessels for process control is considered to be known to the art and has not been shown. The briquettes produced in briquetter 102 are passed through a line 106 to a curing vessel 108. The use of a curing section may not be required in all instances but when used normally constitutes a vessel etc. where the briquettes are held at a temperature from about 200° to about 600° F. (about 90° to about 320° C.) for a period of time sufficient to improve the stability of the briquettes, reduce the stickiness of the briquettes and the like. Optionally the briquettes may be oxidized slightly in such a curing step. The briquettes are then passed through a line 110 to a screen 114 where any undersize material is recovered through a line 116 and recycled to the feedstream to briquetter 102. Clearly the material recycled could be recycled to line 86 as well as line 100. Such variations are considered to be within the skill of those in the art. The briquettes of the desired size, i.e. about ¾ inch to about 3 inches are recovered through a line 118 and combined with the coke from line 74 in a line 120 and passed to a vertical calciner 124. The coke and briquettes are introduced into the top of vertical calciner 124 through a distributor 126 which functions to evenly distribute the coke and briquettes across the cross-sectional area of calciner 124. In the upper portion of calciner 124 a seal gas is injected through a line 128. Downcomers 132 are positioned in the upper portion of calciner 124 to provide seal legs and to serve as a pressure barrier to assist in regulating the pressure inside calciner 124. The downcomers are considered to be known to those skilled in the art. The openings are desirably sized to accommodate the coke and briquettes and are typically from about 2 to about 5 times the largest diameter solids charged to the calciner. As the solids move downwardly through downcomers 132, they are heated by rising gases from the high temperature portion of calciner 124 which is at generally the middle section of the calciner vessel. Air, oxygen or other free oxygen-containing gas is injected through a line 134 to combust either an added fuel such as coke fines, fuel gas or a portion of the coke to produce temperatures in the vicinity of about 2000° to about 2950° F. (about 1090° to about 1625° C.) in the desulfurizing (high temperature) portion of calciner 124. The length of calciner 124 is selected so that the residence time of the coke and briquettes in the high temperature portion of the calciner is sufficient to result in a reduction of the sulfur content of the resulting metallurgical grade coke to a value less than about 1 weight percent sulfur. The rising gases from the high temperature portion of calciner 124 pass through the downcoming solids heating the solids to a temperature approximating that in the desulfurizing (high temperature) portion of the calciner. The rising gases are then recovered through a line 146 and passed to further processing. In the lower portion of calciner 124, a low temperature gaseous stream is added through a line 136. This gaseous stream is at a relatively low temperature, i.e. below about 150° F. (about 65° C.) and tends to cool the descending solids as they pass below the high temperature portion of calciner 124. A second set of downcomers 142 is provided to assist in controlling the pressure in calciner 124 with these downcomers 142 being positioned near the bottom of calciner 124. Downcomers 142 are similar to downcomers 132 and permit the passage of the now calcined, desulfurized coke. A seal gas is injected through a line 138. The product solids are recovered and passed to product storage through a line 144. The gases charged to calciner 124 through lines 128, 134 and 138 are charged by any means known to those skilled in the art suitable for distributing the injected gas relatively uniformly across the cross-sectional area of calciner 124. Such means are considered to be known to those skilled in the art and may comprise a plurality of injection points such as tuyeres positioned about the circumference of calciner 124, injection tubes positioned centrally downwardly through the top of calciner 124, etc. A variety of such techniques are known to those skilled in the art and need not be discussed in detail since it is considered within the skill of those in the art to select a suitable method. Further, the heat required in calciner 124 may be generated, at least in part, by combusting a light fuel gas such as is available in line 136 with a portion of the air, oxygen or other free oxygen-containing gas charged through line 134 by combining the streams via a line 158 and a valve 160 for combustion in the tuyeres, by burning green coke or other finely divided coke up to about 10 weight percent of the total carbon charged to calciner 124 (not shown) which may be injected through the tuyeres, by burning normally liquid fuels which may be similarly injected as either a gas or a liquid etc. Further, other means of heating such as electrical or the like may be used. Clearly, the use of other fuels etc reduces the amount of coke product consumed to generate heat. The operation of vertical calciners per se is not considered to constitute a part of the present invention since the novelty of the present invention is considered to lie in the process as a whole for producing the desired metallurgical grade coke, fuel gases and distillable hydrocarbonaceous products rather than the specific equipment used in the various steps. The vaporous stream recovered through line 146 will contain substantial quantities of hydrocarbonaceous materials which are recoverable by a variety of methods, with the recovery being shown in the FIGURE in an oil scrubber 150 where a stream of oil is injected via a line 152 to condense and absorb hydrocarbonaceous materials from the vaporous stream flowing through line 146 with the resulting stream containing the injected oil and the recovered hydrocarbonaceous materials being recovered through a line 154. The resulting gaseous stream containing nitrogen, carbon oxides, hydrogen, light hydrocarbonaceous fuels and the like is recovered through a line 136, optionally cooled further, at least partially desulfurized, and recycled to calciner 124. In many instances there will be a net make of low Btu gas which is recovered through a line 156 and passed to use as a fuel, further processing to yield methane, hydrogen or the like. The stream recovered through line 154 is recycled to combine with a stream flowing through a line 58 which is a bottom stream from a fractionating vessel 50. The bottoms stream flowing through line 58 is recycled to the feedstream to coking drums 32 and 38. The stream flowing through line 154 in many instances will contain entrained solids and the like recovered from calciner 124. Such materials are suitably recycled to the coking operation. The feedstreams to fractionator 50 comprise the vaporous overhead stream recovered from coking drums 32 and 38 through line 44 and a vaporous overhead stream recovered from topping still 92 through line 96. The feedstreams to fractionator 50 may be cooled or otherwise treated as known to the art prior to charging to fractionator 50 which may comprise a plurality of fractionator vessels as known to the art. In fractionating vessel 50 an overhead stream comprising light hydrocarbonaceous fuels which may be normally used as gaseous fuel products or the like is recovered through a line 51 with a heavier fraction of liquid hydrocarbonaceous fuels being recovered through a line 52 and a still heavier fraction being recovered through a line 54, shown in the FIGURE as the wash oil used in vessel 150. A still heavier fraction is recovered through a line 56. The fraction recovered through line 56 is shown flowing to a hydrogenation vessel 170 where hydrogen is supplied through a line 172 to produce a hydrogenated fuel stream recovered through a line 174. The bottoms are recovered through line 58 as noted above. The resulting product streams recovered through lines 51, 52, 54, and 56 may be used as a feedstream to a refining operation or the like. One of the streams recovered from fractionator 50 may comprise a diluent used to facilitate handling of the crude oil and may be recycled for reuse as a crude oil diluent for additional quantities of crude oil. As is well-known to those skilled in the art a variety of fractions can be taken from a fractionating vessel such as fractionator 50 with the streams optionally being passed to further refining to produce petroleum products such as synthetic natural gas, liquified petroleum fuels, gasoline, kerosine, diesel fuel, fuel oils and the like.

The crude oils contemplated as a feedstock to the process of the present invention, as noted previously, are heavy high sulfur crude oils which are difficultly processed by normal refinery techniques. Such crude oils in many instances are nearly solid or may be solid at normal handling temperatures. As a result, such crude oils are often recovered and transported in mixture with a suitable hydrocarbon diluent. When such feedstreams are used, and in fact when many crude oils, even without diluent, are used as a feedstream to delayed coking operations, the first step is normally a topping operation to produce a resid stream which is then used as a feedstream to the coking drums. In the practice of the present invention, the topping operation may be omitted and the crude oil including any diluent charged directly to the coking drums to produce delayed coke and a vaporous stream. While a portion of the crude oil charged is topped for use as a binder in the briquetting operation, this portion of the crude oil will normally constitute $\frac{1}{4}$ or less and typically less than 10% of the total crude oil charged to the process. In some instances it may not be necessary to top the crude oil even when the crude oil is fixed with diluent. In such instances, additional quantities of fuel gases and distillate materials will be recovered from calciner 124. Clearly, when the topping of the crude is not required, the process requires no topping equipment. It is clear that an expensive refinery operation has been eliminated or the required equipment greatly reduced in size and in particular when heavy high sulfur crude oils such as are contemplated as a feedstock in the present invention are used, such topping operations become more difficult because of the tendency of the heavy crude oils to coke the internals of the topping vessel. As a result, the process of the present invention provides a substantial improvement over previous methods since not only is an expensive refinery operation which is subject to operating difficulties eliminated or reduced but, the heating of the crude oil stream charged to the delayed coking drums is also facilitated since the presence of the diluent results in less difficulty with coking in the furnace tubes used to heat the charge stream to the coking drum to a suitable temperature. Further, crude oils which may be unsuitable for the production of petroleum coke are suitable as a feedstock to the present process since the presence of substantial amounts of metals in blast furnace quality coke is permissible whereas in petroleum coke a high metals content renders the product unsuitable for most uses for which petroleum coke is intended. Further, the process of the present invention in addition to lowering the sulfur content of the resulting blast furnace grade coke, results in the recovery of fuel gases and a valuable distillable hydrocarbon stream which can be passed to refining by standard refiner techniques since the heavy constituents of the charged crude oil including most of the metal contaminants have been processed into a solid product leaving the distillable materials in a form readily accepted by most refinery operations. The distillable streams may contain substantial quantities of sulfur but the sulfur is now of a form such that it is readily removed by standard refinery processes for the removal of sulfur.

References to size herein, refer to solids which have a size such that they will or will not pass through an opening of a given size of any standard configuration such as squares, circular or the like. For instance, a size less than about ¾ inch refers to a solids stream which comprises solids which will pass through a ¾-inch screen. Similarly, a size from about ¾ inch to about 3 inches refers to a stream of solids which will not pass through a ¾-inch screen, but which will pass through a 3-inch screen. Such nomenclature is believed to be standard to the art as are the references to Tyler Mesh screen sizes.

In the practice of the present invention, while reasonable variations are possible, it is anticipated that in most instances coking drums 32 and 38 will operate at temperatures above about 830° F. (about 445° C.) so that the distillate stream recovered through lines 40 and 42 will be recovered at a temperature above about 830° F. (about 445° C.). Similarly, topping still 92 will typically operate at a temperature selected to produce a resid of a consistency suitable for binding the finely divided coke into briquettes.

In the event that the coke produced in drums 32 and 38 has sufficient strength and is suitable for use as bulk in the production of blast furnace grade coke, the coke may be separated into a portion of a size suitable for use as a blast furnace coke bulk, i.e. from about ¾ inch to about 3 inches which is passed directly to calciner 124 and a second portion comprising the remaining coke at least a portion of which is passed to briquetting. The briquettes and the coke may then be charged to the calciner in mixture or separately as desired. In the event that the coke is not suitable for the production of blast furnace grade coke, the coke may all be passed to briquetting, as shown through line 65. The briquettes are then charged to the vertical calciner to produce blast furnace grade coke.

EXAMPLE

High sulfur crude oil having a sulfur content of about 10% by weight is fed to a coke drum. After coking at 900° F. for 15 hours. The coke removed from the coke drum has about 11.2% by weight sulfur and is then crushed and blended with a blender of high sulfur crude oil. About 10 percent of the resulting mixture is binder, the remainder being crushed coke. This mixture is briquetted at about 180° F. into 2" by 2" by 1" pillow shaped briquettes. The briquettes are then heated to about 2800° F. Calcining in a vertical calciner is for 12 hours. The resulting calcined briquettes have 0.84 weight percent sulfur, 60 stability factor and 65 hardness factor. If unbriquetted coke is calcined as in the Example its hardness factor is about 47.8. This is too low to be used alone as blast furnace coke.

In carrying out the process of the present invention in accordance with the preferred embodiment as discussed in the Example above, it is preferred that the coking be carried out within the temperature range from about 800° to about 950° F. for a time period from about 10 to about 20 hours. Preferably from about 10 to about 15 percent of the mixture of crushed coke and binder is made up of binder. Preferably the mixture of crushed coke and binder is briquetted within the temperature range of from about 150° to about 200° F. Preferably the calcining temperature is from about 2000° to about 2950° F. for from about 4 to 16 hours. Most preferably the calcining temperature is from about 2750° to 2950° F. Typically the calcined briquettes have a stability factor from 55 to 65 and a hardness factor from 60 to 70.

Perry's Chemical Engineers' Handbook, Fifth Edition, Copyright 1973, pp. 9-5 through 9-8 discuss coke. Under high temperature coke, Perry mentions that nearly 20 percent of the total bituminious coal consumed is used to make high temperature coke for metallurgical applications. About 98 percent of this type of coke is made in slot ovens and the remainder in beehive or other types of ovens. Blast furnaces use about 90 percent of the production, the rest going to foundrys and gas plants and for residential heating. Table 9-6 shows the chemical and physical properties of high temperatures cokes typically used in the thirteen blast furnace coke plants whose capacity represents 30 percent of the total production in the United States. The Table in Perry shows that the hardness factor range from 60 to 68, while the stability factor range from 39 to 58.

It is noted that the coke made in the Example above is within the stability and hardness ranges.

Looking again to the Table of Perry, the sulfur range from 0.6 to 1.1 weight percent. Here again the coke produced in the Example above in accordance with the present invention is sufficiently low in sulfur to be used as blast furnace coke.

Heretofore, high strength, low sulfur blast furnace quality coke has not been available from high sulfur crude oil. Through the process of the present invention, high sulfur heavy crude can be converted into the useful product blast furnace coke. Additionally, a vapor stream from the vertical calciner provides a feedstream for further processing as a distillable hydrocarbonaceous product stream.

If the heating from 600° to 1500° F. is at a rate in excess of 5° F. per minute the strength of the coke briquette substantially diminishes with increasing heating rates.

Having thus described the invention by reference to certain of its preferred embodiments it is respectfully pointed out that embodiments described are illustrative rather than limiting in nature and that many variations and modifications are possible within the scope of the present invention. Such variations and modifications may appear obvious and desirable to those skilled in the art upon a review of the foregoing description of preferred embodiments.

Having thus described the invention, we claim:

1. A process for producing a distillable hydrocarbonaceous product and a high strength coke briquette product suitable for use as blast furnace coke from a heavy high-sulfur crude oil, said process comprising:

(a) feeding said heavy crude oil having 4 or more weight percent sulfur, to a delayed coking drum at conditions of temperature and pressure to thermally decompose said crude oil to produce a mass of solid coke in said coking drum and a distillable stream recovered as a vaporous stream at a temperature above about 830° F. (445° C.) from said coking drum;

(b) grinding at least a portion of said coke to produce finely-divided coke of a size less than about 6 Tyler Mesh;

(c) mixing a suitable binder with said finely-divided coke in suitable proportions to produce a briquettable mixture;

(d) briquetting said briquettable mixture to produce briquettes;

(e) heating said briquettes to calcining temperatures at a rate of not more than 5° F. per minute within the range of from about 600° F. to about 1500° F.;

(f) calcining said briquettes in a vertical calciner at a temperature from about 2000° to about 2950° F. (about 1090° to about 1625° C.) for a time sufficient to substantially reduce the sulfur content of said briquettes;

(g) recovering a calcined product of a size from about ¾ inch to about 3 inches having a sulfur content less than 1.0 percent by weight and a hardness factor of 60 or greater and a stability factor of 39 or greater, suitable for use as a blast furnace grade coke and a vaporous hydrocarbonaceous stream from said vertical calciner; and (h) passing said vaporous stream from said coking drum and said vaporous stream from said vertical calciner to further processing as a distillable hydrocarbonaceous product stream.

2. The process of claim 1 wherein said binder comprises said crude oil.

3. The process of claim 2 wherein of said crude oil is topped to produce a topped crude oil for use as said binder.

4. The process of claim 1 wherein said crude oil charged to said process is in mixture with a hydrocarbon diluent.

5. The process of claim 4 wherein said distillable hydrocarbonaceous product stream is passed to a fractionating zone wherein at least a major portion of said hydrocarbon diluent is recovered for recycle to crude oil dilution.

6. The process of claim 5 wherein a bottoms stream from said fractionating zone is recylced to said delayed coking drum.

7. The process of claim 1 wherein said briquettes are cured at a temperature from about 200° to about 600° F. (about 90° to about 320° C.) prior to charging said briquettes to said vertical calciner.

8. The process of claim 1 wherein said coke is separated into a first portion of a size from about ¾ to about 3 inches and a second portion comprising at least a major portion of the remaining coke with at least a part of said second portion being ground and briquetted to produce said briquettes.

9. The process of claim 8 wherein said first portion of said coke and said briquettes are combined and fed to said vertical calciner.

10. The process of claim 9 wherein said briquettes and said coke are heated in said vertical calciner by injecting controlled amounts of a free oxygen-containing gas into said vertical calciner.

11. The process of claim 10 wherein said vaporous hydrocarbon-containing stream from said vertical calciner is separated into a gaseous stream containing light hydrocarbons and inert gases and a liquid hydrocarbon stream.

* * * * *